US005706745A

United States Patent [19]

Neely et al.

[11] Patent Number: 5,706,745

[45] Date of Patent: Jan. 13, 1998

[54] TUFTING MACHINE BELT DRIVEN DRIVE ASSEMBLY

[75] Inventors: Marshall Allen Neely, Hixson; Paul E. Beatty, Oak Ridge, both of Tenn.

[73] Assignee: Card-Monroe Corp., Chattanooga, Tenn.

[21] Appl. No.: 754,499

[22] Filed: Nov. 20, 1996

Related U.S. Application Data

[60] Provisional application No. 60/007,434, Nov. 21, 1995.

[51] Int. Cl.[6] ..... D05C 15/24

[52] U.S. Cl. ..... 112/80.55

[58] Field of Search ..... 112/80.01, 80.5, 112/80.55, 80.4, 220, 221

[56] References Cited

U.S. PATENT DOCUMENTS

| | | | |
|---|---|---|---|
| 3,361,096 | 1/1968 | Watkins . | |
| 3,618,544 | 11/1971 | Watkins | 112/80.55 X |
| 3,919,952 | 11/1975 | Lund | 112/80.5 X |
| 4,187,788 | 2/1980 | Cobble | 112/80.55 X |
| 4,419,944 | 12/1983 | Passons et al. . | |
| 4,586,445 | 5/1986 | Card et al. . | |
| 4,587,914 | 5/1986 | Card et al. | 112/80.5 X |
| 4,665,845 | 5/1987 | Card et al. . | |
| 4,860,673 | 8/1989 | Ward et al. | 112/80.4 |
| 5,513,586 | 5/1996 | Neely et al. | 112/80.01 |

FOREIGN PATENT DOCUMENTS

| | | |
|---|---|---|
| 699657 | 11/1953 | United Kingdom . |
| 1098219 | 1/1968 | United Kingdom . |
| 1335217 | 10/1970 | United Kingdom . |
| 1304151 | 1/1973 | United Kingdom . |
| 1507201 | 4/1978 | United Kingdom . |
| 2181163A | 9/1985 | United Kingdom . |
| 2283987 | 4/1994 | United Kingdom . |

*Primary Examiner*—Paul C. Lewis
*Attorney, Agent, or Firm*—Isaf, Vaughan & Kerr

[57] ABSTRACT

A tufting machine belt driven drive assembly (5) for use with a tufting machine (7) is disclosed. The drive assembly includes a spindle assembly (24) rotatably supported on the tufting machine with respect to a looper drive shaft (31) and a spaced and parallel knife drive shaft (34). The spindle assembly is rotated in timed relationship with the rotation of tufting machine drive shaft (16) by a drive sprocket (20) mounted on the tufting machine drive shaft, a flexible timing belt (21) encircling the drive sprocket and a driven sprocket (23) formed as a part of the spindle assembly. The spindle assembly has a pair of cam assemblies (**52*a*, 52*b*) affixed to the spaced ends (41, 42) of the spindle shaft, each cam assembly having an offset stub shaft (54*a*, 54*b*) with respect to the longitudinal axis of the spindle shaft for orbiting the spindle shaft. An elongate drive pinion (58*a*, 58*b*) is pivotally fastened at one end to each respective stub shaft, the other end of each drive pinion being pivotally fastened to the first end of an elongate drive lever (66*a*, 66*b*) for transmitting the reciprocating motion of the drive pinion as a rocking motion to the drive lever for rocking the looper drive shaft and the knife drive shaft, respectively, in timed relationship with the rotation of tufting machine drive shaft 16. Each cam assembly is positioned adjacent a timing disc (47*a*, 47*b*) having a timing reference mark (50a, 50b) defined thereon. Each one of the cam assemblies has a series of timing indicia (55*a*, 55*b***) defined thereon and in registry with each respective timing reference mark.

27 Claims, 6 Drawing Sheets

TUFTING MACHINE BELT DRIVEN DRIVE ASSEMBLY

CROSS REFERENCE TO RELATED APPLICATION

This Application claims priority to Provisional Application Number 60/007,434 filed in the United States Patent and Trademark Office on Nov. 21, 1995.

FIELD OF THE INVENTION

This invention relates in general to tufting machinery. More particularly, this invention relates to a tufting machine having a belt driven looper and knife drive assembly for use in the production of tufted cut pile articles.

BACKGROUND OF THE INVENTION

The use of tufting machines for creating tufted articles, for example tufted carpet, is well-known in the art. In conventional tufting machines, a reciprocating needle bar carries a plurality of aligned needles thereon, the needles being constructed to reciprocably penetrate a backing material passing transversely underneath the needle bar through a tufting zone. As the needles penetrate the backing material, they carry a yarn therethrough, whereupon the yarn is caught either by a looper to create a tufted pile article, or by a looper/hook moved in time relationship with a knife to create a loop of tufted material which is then cut to create a cut pile article. It is by this process, for example, in which tufted cut pile carpeting is made.

Early tufting machines used mechanical devices to reciprocate the needle bar, the loopers, and the looper/knife arrangement of the machine in timed relationship with one another. Thus, in early tufting machines a main drive shaft was rotated by a drive source, most commonly a motor, with the rotation of the tufting machine drive shaft being used to reciprocate the needle bar toward and away from the tufting zone, as well as moving the looper, and/or looper/knife mechanisms in timed relationship with the needles passed into the tufting zone. Early examples of tufting machines used eccentric cams mounted on the tufting machine drive shaft to reciprocate a push rod attached to the needle bar for reciprocating the needles in turn, and using either push rods or straps engaged with additional eccentric cams on the main drive shaft of the machine to operate the looper and/or looper/knife mechanisms. Although these tufting machines have proven themselves to be durable and capable of creating a high quality tufted product, the problem with these machines has been the inherent limitations of the mechanical connection or interlinking of the operation of the needle bar, the looper drive, and the knife drive which resulted in increased mechanical drag and led to the creation of heat and increased friction, which in turn led to increased wear and vibration in the drive train, all of which resulted in diminished production efficiency as well as increased machine down time and maintenance/repair costs required to keep the tufting machines in proper working order.

An example of an early tufting machine which uses this kind of mechanical drive system for the creation of tufted products is disclosed in U.S. Pat. No. 3,361,096 to Watkins, as well as in British Patent No. 1,507,201, and British Patent No. 1,304,151. In the effort to get away from using cams with straps or push rods, the use of belt driven components of tufting machines has developed. An early example of this is the multiple stroke looper mechanism for a stitching machine disclosed in U.S. Pat. No. 4,419,944 to Passons, et al. Passons, et al. teach the use of a drive chain passed over a sprocket on the tufting machine drive shaft and a spaced second sprocket to which an eccentric cam shaft is attached, the eccentric cam shaft being used to reciprocate a push rod for rocking the loopers disposed within the tufting zone back and forth with respect to the reciprocation of the needle to create longitudinal rows of stitching in a base fabric in which the looper is driven through two or more strokes for each stroke of the needle in a stitch cycle. In Passons, et al., however, an eccentric cam was still employed on the tufting machine drive shaft for moving a push rod to reciprocate the needle bar, and an eccentric cam mounted in close proximity to the tufting machine drive shaft was still used to drive the loopers in timed relationship thereto, thus requiring the use of a relatively long push rod/crank to rock the loopers with the resultant problem of mechanical vibration, stress, and wear in the looper drive train. Although Passons, et al. represented a novel advance in the art, the problem of using a primarily mechanical link system in tufting operations persisted, which did not allow for the increased tufting speeds and serviceability demanded in the tufting industry.

U.S. Pat. Nos. 4,586,445, and 4,665,845, to Card et al., respectively, disclose a high speed tufting machine in which a flexible timing belt is used to drive the needle bar by transmitting the rotation of the tufting machine drive shaft to an offset sprocket, the sprocket being one of a series of aligned sprockets along the length of the tufting machine and having a push rod fastened thereto for reciprocating the needle bar with respect to the tufting zone. These two patents to Card, et al. represented a significant advance in the art in allowing still greater production speeds in the creation of tufted products because higher needle bar speeds were now attainable, however Card, et al. did not focus on how the looper drive shaft and the knife drive shaft, if one was present, would be moved in timed relationship with the reciprocation of the needle bar to take full advantage of the improved speed feature of the needle bar drive system.

The tufting machines taught by Passons, et al., and by Card et al., were followed with the patent to Neely, et al., U.S. Pat. No. 5,513,586 in which a belt driven looper drive assembly was disclosed. In Neely, et al., a looper drive assembly is spaced from the main drive shaft of the tufting machine, with a flexible timing belt encircling a pair of sprockets used to rotate a spindle assembly. The spindle assembly has an eccentric cam mounted on the end thereof, to which a push rod is pivotally fastened for transmitting the rotational motion of the tufting machine drive shaft, through the spindle shaft, into a reciprocating motion whereby a lever is fastened to the push rod for transmitting this reciprocating motion into a rocking motion of the looper drive shaft.

However, neither Neely, et al., nor the patents to Card, et al., or Passons, et al., focused on improvements to tufting machines used for the creation of a cut pile tufted loop in which a series of knives, one knife for each looper or hook, is provided and moved in time relationship with the looper in order to cut the tufted pile, as known in the production of tufted cut pile carpeting and other similar articles. What is needed in tufting machines used for the creation of cut pile articles is a tufting machine which allows for increased production rates, improved serviceability of components, reduced manufacturing costs, and which will allow for the precision adjustment of the loopers, and of the knives, with respect not only to each other, but with respect to the tufting machine drive shaft so that the loopers and knives are moved in precise relationship with respect to the reciprocating needles of the tufting machine, and off of which the entire tufting operation is keyed.

In conventional cut pile tufting machines, separate drive assemblies have been used for powering the looper drive shaft and knife drive shaft of the tufting machine, one each of these mechanisms being provided for the looper and knife drive shafts at both ends of the machine across the width of the tufting zone, so that two looper drive systems, and two knife drive systems have commonly been employed in the industry. For example, Neely, et al. teach only a looper drive assembly so that separate knife drive assemblies are still required if the device of Neely, et al. is to be used in a cut pile tufting machine. Moreover, and although Passons, et al. and Neeley, et al. have disclosed belt driven drive systems, these systems focus only on drive systems for loop pile tufting machines in which the loopers do not have the same loading requirements which exist in cut pile production in which a knife blade is repeatedly engaged with the looper and the yarn carried thereby at a high rate of speed as the looper is simultaneously drawn back from the needle to create the looped pile of yarn to be cut. This results in greatly increased loads on the loopers or hooks of a cut pile system, and requires the ability to precisely adjust the loopers with respect to the knives, and vice versa, and each with respect to the needle bar so that still higher production rates can be attained.

What has been needed, therefore, but seemingly unavailable in the art is an improved tufting machine belt driven drive assembly for powering both the loopers and knives of a cut pile tufting machine which allows for the precise adjustment of the loopers and knives with respect to one another, and with respect to the tufting machine drive shaft, but yet which also provides a reduced mass to allow for increased operational speeds, and improved serviceability. What has also been needed, but unavailable in the art, is a reduced mass looper and knife drive system which is constructed to accommodate the increased loading of a looper in a cut pile tufting machine, and which allows for the precise adjustment of the loopers and knives with respect to one another. What is also needed is a belt driven tufting machine drive assembly for powering both the loopers and knives of a tufting machine which allows for precision stroke control of the spaced looper and knife drive assemblies at each end of the looper and knife drive shafts of the tufting machine to eliminate any torque stress loading, or torque within the looper and knife drive shafts for improved machine reliability and a high quality tufted cut pile article.

The known devices are not constructed to perform these tasks, and they fail to suggest how this may be reasonably accomplished. What is still needed, therefore, is an improved belt driven tufting drive assembly constructed to drive both the loopers and the knives of a cut pile tufting machine which provides for a simple, yet durable and rugged apparatus which is simple in design and inexpensive to construct, which allows for improved serviceability, and allows for improved production rates demanded in high speed tufted cut pile manufacturing operations.

SUMMARY OF THE INVENTION

The present invention provides an improved tufting machine belt driven drive assembly which overcomes some of the design deficiencies of other belt driven drive assemblies known in the art, and which represents a significant advance in the art. The improved tufting machine belt driven drive assembly of this invention provides a highly flexible drive assembly for powering both the loopers and knives of a tufting machine in precise timed relationship with respect to one another, as well as with respect to the rotation of the tufting machine main drive shaft, and thus the reciprocation of the needle bar with respect to the tufting zone. As a result of these improvements, improved tufting machine operating speeds on the order of 25% greater than current operating speeds are attainable while allowing for a simple, serviceable, and reliable drive assembly well suited for use in modern high speed tufting operations.

The improved tufting machine belt driven drive assembly of this invention can be matched to the production needs of both the cut pile and looped pile tufted article producer, and thus provides for a much greater degree of flexibility in tufting machine operation than heretofore known in the art. Tufting machine operators will now be allowed to more precisely control the manufacture of loop pile and cut pile tufted articles at far greater production rates than those previously known in the art, with a simplified mechanism which reduces both machine down time and machine maintenance costs. Accordingly, this invention provides a simple and efficient belt driven tufting drive assembly that is readily adapted for use in both high and low speed tufting operations, and is well-suited for use with a large number of tufted article types and configurations without the need for other sophisticated machinery or devices.

This invention attains this high degree of flexibility, yet maintains simplicity in design and operation, by providing a spindle assembly mounted on a lower portion of the frame of a tufting machine with respect to both the looper drive shaft and the knife drive shaft, and spaced from the tufting machine drive shaft positioned on an upper part of the frame. The spindle assembly is rotatably supported on the frame of the machine and has a spindle shaft extending along a longitudinal axis parallel to both the looper drive shaft and the knife drive shaft. A drive sprocket is mounted on the tufting machine drive shaft in registry with a driven sprocket mounted on the spindle shaft, with a flexible timing belt encircling both sprockets for transmitting the rotational movement of the tufting machine main drive shaft to the spindle shaft. The spindle shaft has a pair of spaced ends protruding from the spindle assembly. A first cam assembly is mounted on the first end of the spindle shaft and has an offset stub shaft protruding therefrom for orbiting the axis of the spindle shaft during its rotation. A first elongate drive pinion is pivotally fastened at one of its ends to the stub shaft for transmitting the rotational motion of the spindle shaft into a reciprocating motion. A first elongated lever is pivotally fastened at one of its ends to the second end of the drive pinion and fixed at the other of its ends on the looper drive shaft for transmitting the reciprocating motion of the drive pinion as a rocking motion of the looper drive shaft, and of the loopers disposed thereon, toward and away from the tufting zone of the machine.

In similar fashion, a second cam assembly is mounted on the second end of the spindle shaft, and carries a second stub shaft protruding therefrom and being offset not only with respect to the axis, but also with respect to the first stub shaft, if so desired, for orbiting the axis during rotation of the spindle shaft. A second elongate drive pinion is pivotally fastened at one of its ends to the second cam assembly for transmitting the circular motion of the spindle shaft into a reciprocal motion, whereupon a second elongate lever is pivotally fastened at one of its ends to the second drive pinion and fixed at the other of its ends on the knife drive shaft for transmitting the reciprocating motion of the second drive pinion as a rocking motion of the knife drive shaft, and of the knives thereon toward and away from the loopers in timed relationship with the movement of the loopers toward and away from the tufting zone.

The cam assemblies mounted on the two spaced ends of the spindle shaft each comprise a split face clamp fastened to the ends of the spindle shaft, and being positioned adjacent a timing disc affixed to the spindle shaft. Each timing disc has a timing reference mark thereon, and each split face clamp has a series of timing indicia contained thereon and placed in registry with the timing reference mark of the timing disc so that the cam assemblies can be moved through a defined range about the spindle axis for adjusting the stroke of the loopers with respect to the stroke of the knives, and also with respect to the rotation of the tufting machine drive shaft and thus with respect to the stroke of the needles through the tufting zone. This construction allows for a simple yet durable cam assembly which allows for the precise stroke adjustment of the loopers or knives, respectively. When it is desired to change the cam assembly, for example to move to a different pre-defined stroke control range, the split face clamp assembly can be easily and quickly removed from the end, or ends of the spindle shaft, and replaced with the appropriate cam assembly having the newly desired cam profile.

Lastly, the improved tufting machine belt driven drive assembly of this invention allows for yet a further adjustment of the stroke of the loopers and knives with respect to one another by providing an elongate slot in the end of each lever pivotally fastened to the respective drive pinions, so that the loopers and/or knives, through the looper and knife drive shafts, respectively, can be phased with respect to one another for any final precision adjustments needed.

An alternate embodiment of the cam assemblies is also provided, in which a cam disc is fastened to a drive plate, a drive plate being affixed to each one of the ends of the spindle shaft. The cam disc contains a pair of spaced arcuate slotted openings secured to the drive disc by a low head screw passed through each one of the openings, so that the cam plate can be adjusted with respect to the drive plate through the range of the arcuate slot to again allow for the precise adjustment of the stroke of the loopers and knives with respect to one another, and with respect to the tufting machine main drive shaft, and thus the needles, within the tufting zone.

Accordingly, the unique structure of this invention results in an improved tufting machine belt driven drive assembly for use in the creation of cut pile tufted products, yet does so in a simple, reliable, and durable apparatus which allows for precise stroke control adjustments to a degree heretofore unknown in the art. Moreover, the apparatus of this invention provides for improved stroke control adjustments which will minimize the amount of time required to set up the tufting machine prior to the start of tufting operations, and which will also allow for quick stroke control adjustment during the creation of tufted products. The present invention accomplishes the above-stated objects while providing for flexible, efficient, and continuous tufting operations.

DETAILED DESCRIPTION OF THE PREFERRED EMBODIMENT

Figure 1:
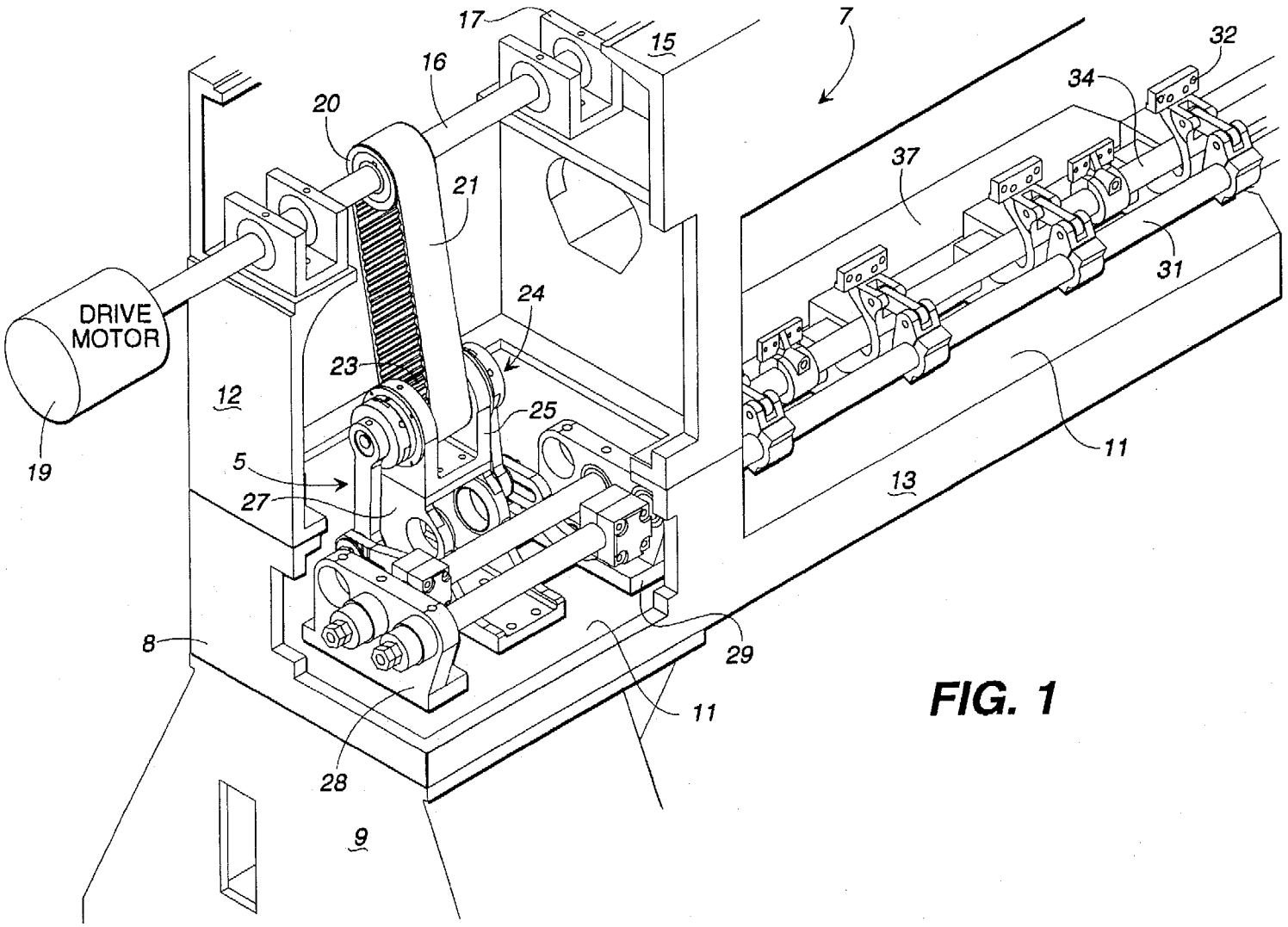
FIG. 1 is a partially cut away perspective view of a preferred embodiment of the improved tufting machine belt driven drive assembly of this invention positioned on a tufting machine.

Referring now to the drawings, in which like reference numerals indicate like parts throughout the several views, numeral 5 of FIG. 1 illustrates a preferred embodiment of the improved tufting machine belt driven drive assembly of this invention. As shown in FIG. 1, drive assembly 5 is used as part of a tufting machine 7. Tufting machine 7 has a frame 8, including legs 9, a generally horizontal base plate 11, an end plate 12, a side plate 13, a rear plate 14 (FIG. 5), and a top plate 15, all of which are common to the known tufting machines of the art.

Still referring to FIG. 1, tufting machine 7 includes an elongate tufting machine drive shaft 16 which extends the length of the machine, and is supported on a series of spaced bearing assemblies 17 in known fashion. So constructed, tufting machine drive shaft 16 is free to rotate within bearing assemblies 17. Tufting shaft 16 is powered by a drive motor 19, illustrated schematically in FIG. 1. Drive motor 19 may be an electric motor, for example an AC or DC motor, or may be a servomotor if so desired.

Figure 2:
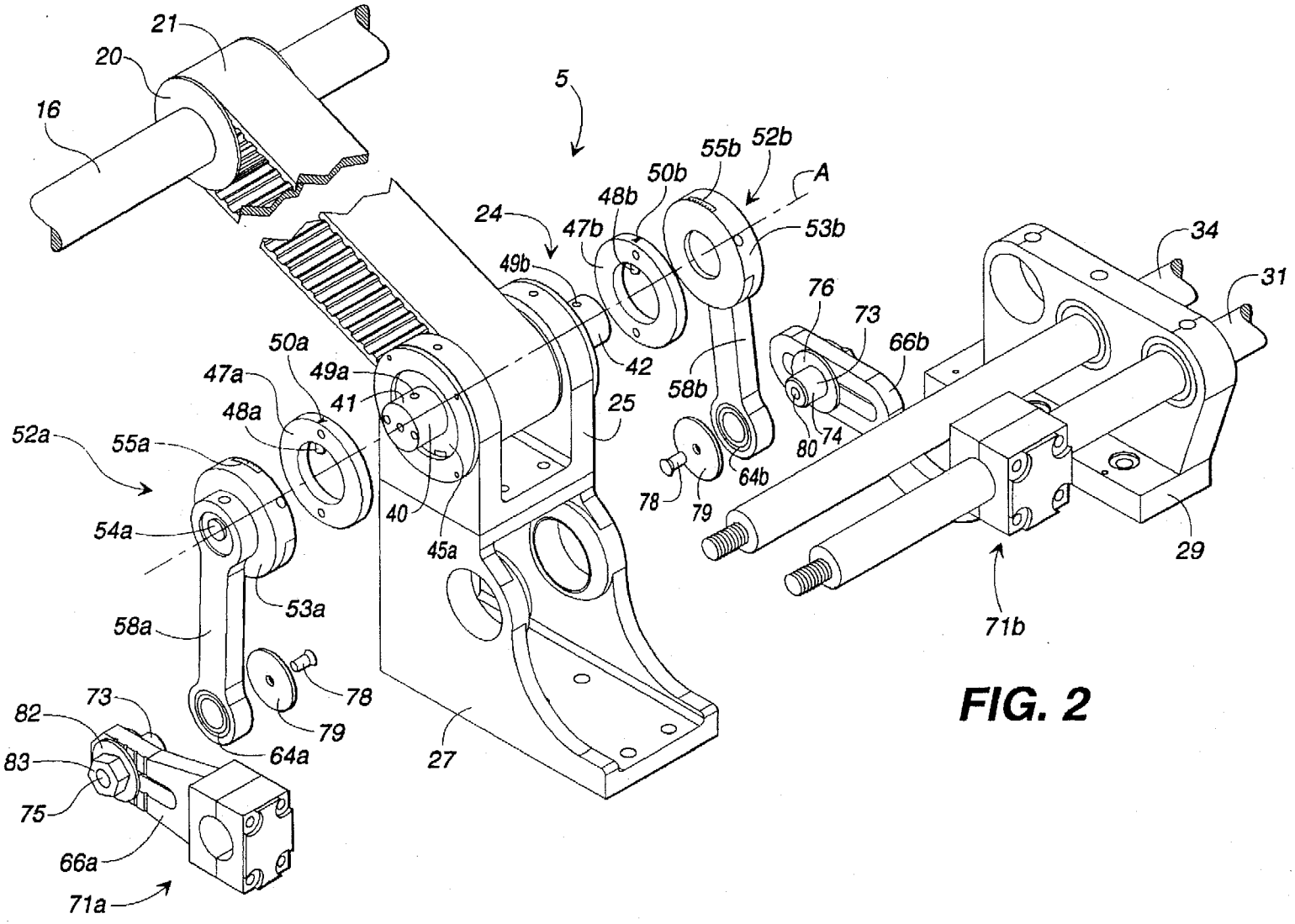
FIG. 2 is an exploded perspective view of the embodiment of the belt driven drive assembly of FIG. 1.

A drive sprocket 20 is mounted on drive shaft 16 and is encircled by a timing belt 21 which is also passed over a spaced driven sprocket 23 formed as a part of spindle assembly 24, spindle assembly 24 being a part of drive assembly 5. Drive sprocket 20 and driven sprocket 23 are moved at a 1:1 ratio by flexible timing belt 21. This ratio may be adjusted by changing out either one of sprockets 20, 23 to attain a desired drive ratio of the tufting machine drive shaft with respect to the spindle shaft 40 (FIG. 2).

Spindle assembly 24 is supported on a spindle support 25, which is itself supported on a support block 27. Assembly 5 also includes a pair of spaced support blocks, a left end support block 28, and a right end support block 29. Received within support blocks 28 and 29 is an elongate looper drive shaft 31, having a plurality of modular looper assemblies 32 thereon, as illustrated generally in FIGS. 1 and 5. Support blocks 28 and 29 also receive a knife drive shaft 34 therein, the knife drive shaft having a plurality of modular knife assemblies 35 (FIG. 5) disposed thereon with respect to the looper assemblies 32, and with respect to a tufting zone 37 defined on the machine, as also illustrated generally in FIGS. 1 and 5.

Looper drive shaft 31 and knife drive shaft 34 are each supported for rotation within support blocks 28, 29 by suitable beating assemblies. Although not illustrated specifically herein, each bearing assembly is retained within the support block by a pair of retaining rings slid over the respective looper and knife drive shafts as they are passed through the support blocks, the retaining rings being held in place by set screws or by other suitable means to ensure that the bearing assemblies are held in position within the support blocks for allowing the rotation, i.e. the rocking, of drive shafts 31 and 34. The bearing assemblies in the support blocks may be any suitable type of bearing assembly adapted to support a shaft for rotation, although a roller bearing assembly is preferred. As illustrated generally in FIGS. 1 and 3, the free ends of drive shafts 31, 34 are threaded, and are passed through, for example in FIG. 1, left end support block 28 whereupon one of the above-described retaining rings is passed over the end of the shaft for holding the bearing assembly within the support block, with a washer and a pair of nuts being passed over the threaded end of the drive shaft to secure it in position on the end support block. This is done for both the looper drive shaft and the knife drive shaft.

Although only one belt driven drive assembly 5 is illustrated in FIG. 1, it is understood by those skilled in the art that an identical belt driven drive assembly will be provided at the opposed end of the tufting machine 7, across the width of the tufting zone, so that looper drive shaft 31 and knife drive shaft 34 are each supported and driven at their respective ends in unison, and in timed relationship with the rotation of tufting machine drive shaft 16. Moreover, support blocks 27, 28, 29 are each mounted to base plate 11 by suitable fastening means, for example threaded fasteners, although not illustrated specifically herein.

Figure 3:
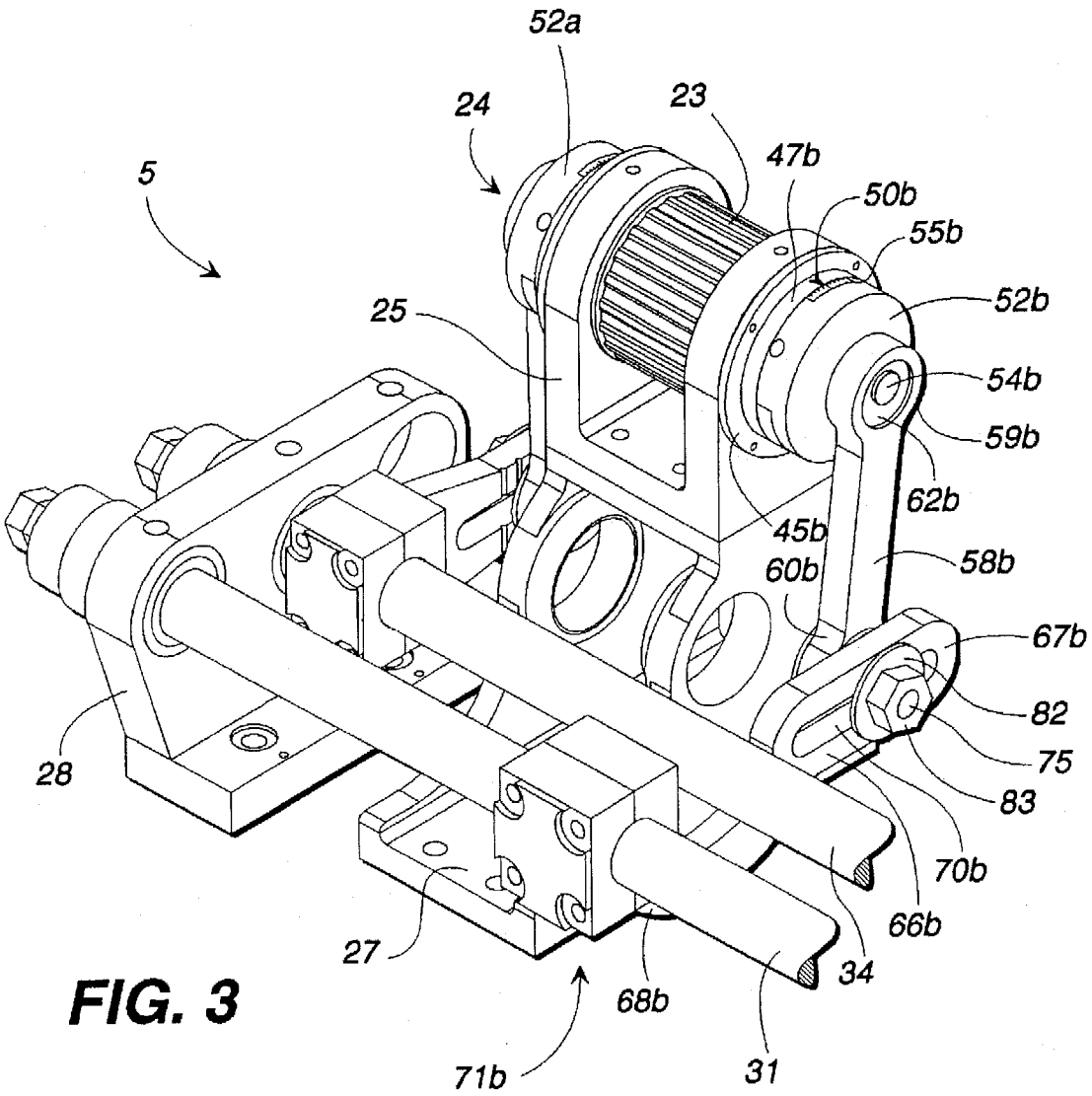
FIG. 3 is a right hand perspective view of the belt driven drive assembly of FIG. 1.
Figure 4:
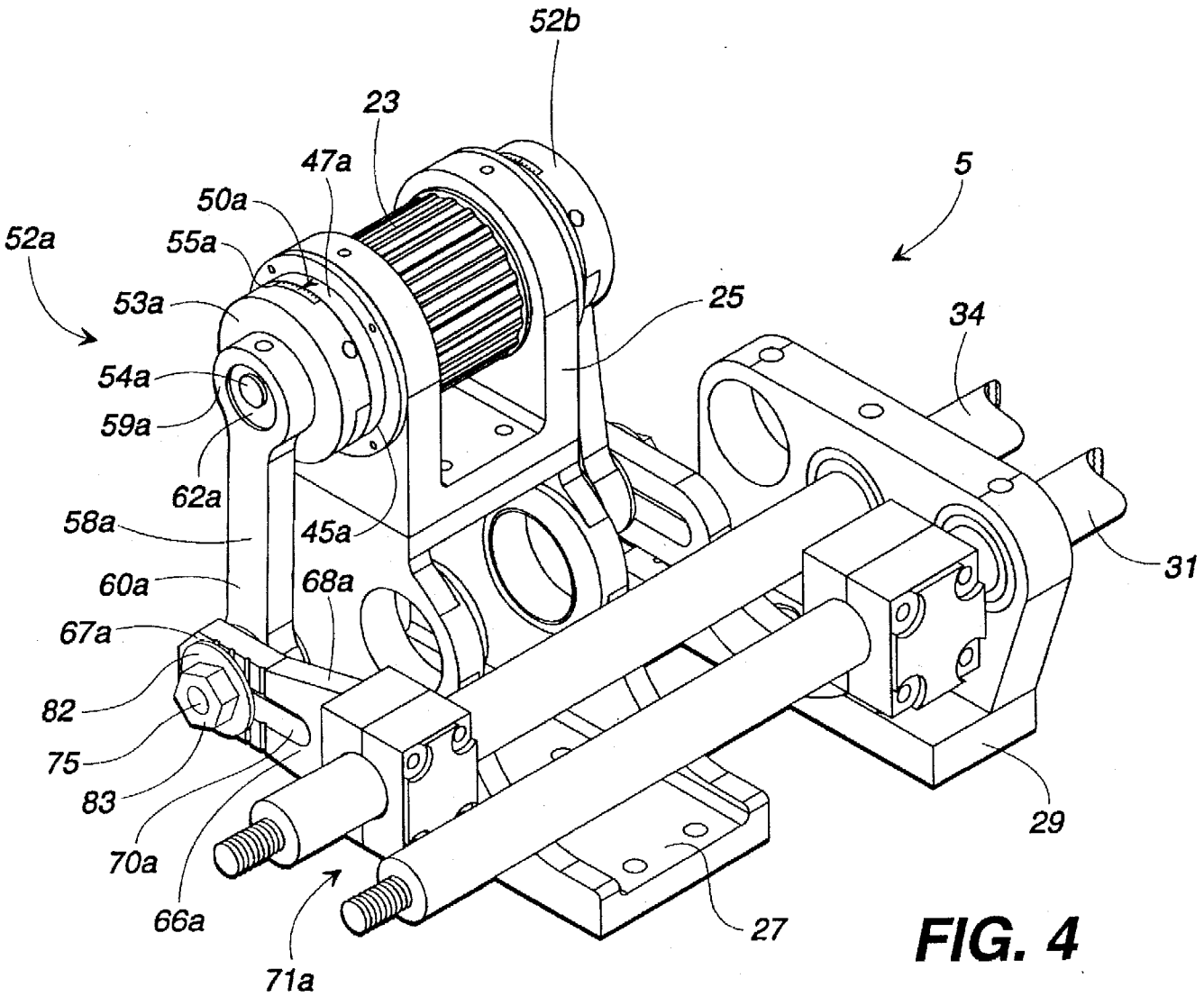
FIG. 4 is a left hand perspective view of the belt driven drive assembly of FIG. 1.

Drive assembly 5 is illustrated in greater detail in FIGS. 2 through 4. Turning first to FIG. 2, drive assembly 5 is illustrated in an exploded perspective view so that its component parts may be more easily understood. As described above, drive assembly 5 includes a spindle assembly 24 supported on a spindle support 25, itself supported on a support block 27. The spindle assembly includes an elongate spindle shaft 40 formed about a longitudinal axis, denoted by the reference character "A", and has a first end 41 and a spaced second end 42. The spindle shaft assembly also includes a pair of bearing carriers **45*a* (FIG. 2), and 45*b* (FIG. 3) each constructed and arranged to fit within a recess (not illustrated) defined within the two arcuate portions of the spindle support. The spindle shaft is passed through each bearing carrier, and each bearing carrier affixed to the spindle support so that the spindle shaft is supported for rotation about its longitudinal axis. Bearing carriers 45*a*, 45*b* are each provided with a roller bearing assembly adapted for high speed continuous operation. Moreover, as shown generally in FIG. 1, spindle shaft 40 is positioned parallel to tufting machine drive shaft 16 and to both looper drive shaft 31 and knife drive shaft 34. Additionally, spindle shaft 40 is located on a lower portion of the tufting machine whereas the tufting machine drive shaft is located on an upper portion of the tufting machine spaced from and with respect to drive assembly 5**.

Figure 5:
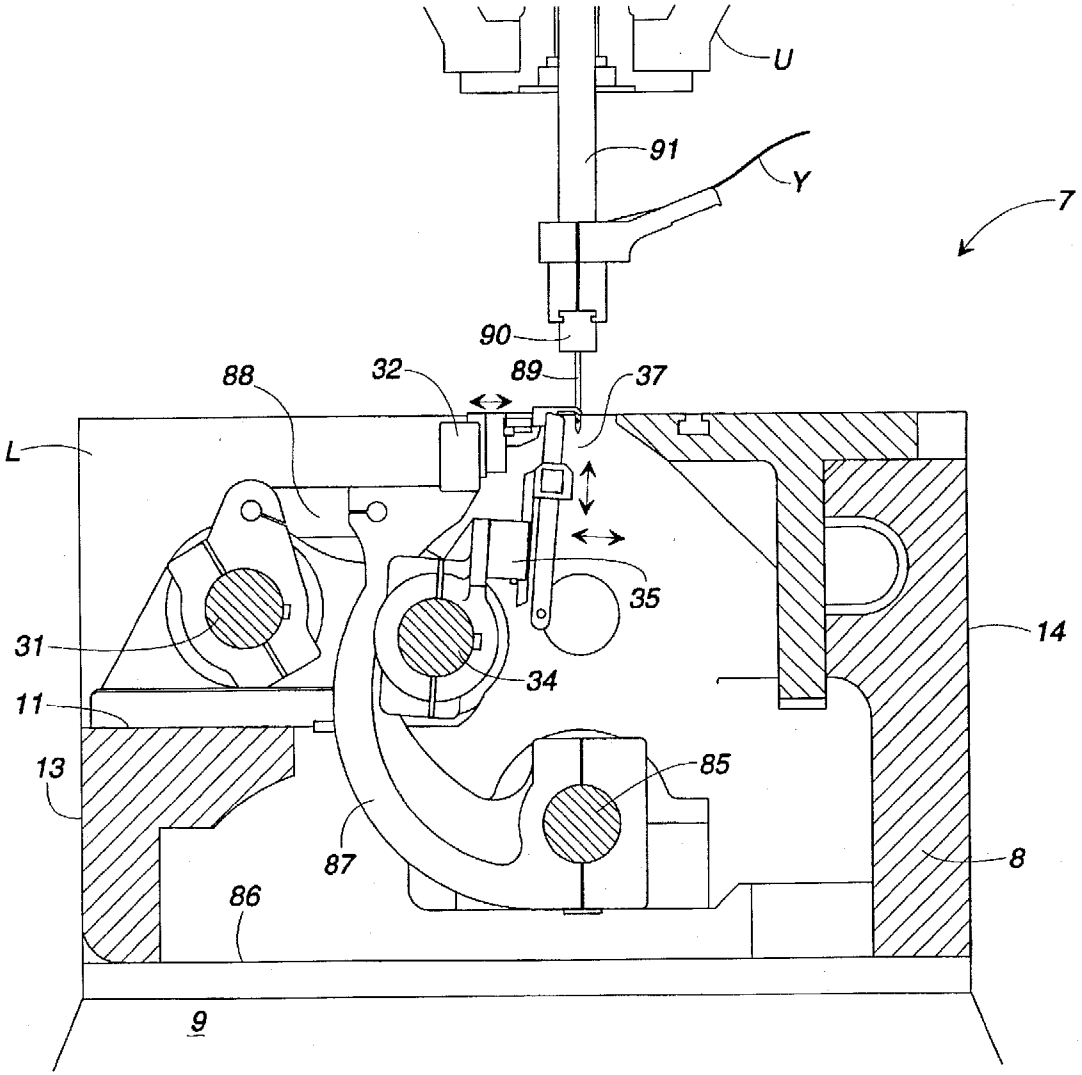
FIG. 5 is a partial cross-sectioned elevational view through a tufting machine illustrating the components of the tufting machine used in the creation of tufted products, as well as their relationship to one another within the tufting zone of the machine.

Drive assembly 5 includes a pair of annular timing discs **47*a*, 47*b* affixed to the spindle shaft. Each one of the timing discs has a dowel pin 48*a*, 48*b* received in one of two aligned holes 49*a*, 49*b* defined within spindle shaft 40. Each of holes 49*a*, 49*b* is aligned with one another along a common axis. Moreover, each timing disc has a timing reference mark 50*a*, 50*b* scribed or otherwise defined on the periphery thereof so that when each of the timing discs is affixed to spindle shaft 40, dowel pins 48*a*, 48*b* ensure that the timing reference marks will be in alignment with each other at a common home reference point with respect to axis A of spindle shaft 40 for timing, i.e. controlling the stroke, of the modular looper assemblies 32 (FIG. 5) and the modular knife assemblies 35 (FIG. 5**).

An opposed pair of cam assemblies **52*a*, 52*b* are mounted on each of the ends 41, 42, respectively, of spindle shaft 40. Each one of cam assemblies 52*a*, 52*b* is identical to one another, and thus only cam assembly 52*a*** is described in greater detail hereinbelow.

Cam assembly **52*a* comprises a split face clamp 53*a* passed over first end 41 of the spindle shaft, the end of the spindle shaft being received within a recessed counter-bore (not illustrated) defined within the split face clamp. In known fashion, a clamp piece (not illustrated) is provided which is affixed to the main portion of the split face clamp by a pair of retainer screws (not illustrated) so that it will clamp down and secure the clamp, and thus the cam assembly, in a fixed position on the spindle shaft. Formed on the exterior of the split face clamp, and protruding away from the spindle assembly, is a stub shaft 54*a*. Stub shaft 54*a* is offset with respect to the longitudinal axis A of the spindle shaft so that it has an eccentric action and orbits the spindle shaft as the spindle shaft is rotated by timing belt 21. In addition, split face clamp 53*a* has a spaced series of timing indicia scribed or defined thereon which correspond to the allowable stroke control range designed into the cam profile which accompanies the degree of offset, i.e. the location of the stub shaft 54*a* with respect to the axis A of the spindle shaft. Timing indicia 55*a* are placed adjacent timing reference mark 50*a* of timing disc 47*a* as cam assembly 52*a* is placed over the first end 41 of spindle shaft 40, and fastened thereto adjacent timing disc 47*a*. Again, and as mentioned above, cam assembly 52*b* is otherwise identical to cam assembly 52*a*, and thus is also received adjacent its respective timing disc 47*b* so that timing indicia 55*b* are in registry with timing reference mark 50*b***.

An elongate drive pinion **58*a* is pivotally fastened to stub shaft 54*a* for transmitting the orbital motion of the stub shaft into a reciprocating motion. As best shown in FIG. 4, drive pinion 58*a* has a first end 59*a* and a spaced second end 60*a*. A conventional roller bearing assembly 62*a* is fitted within the first end 59*a* of the drive pinion, and is held in place thereon by a snap ting (not illustrated), or rings (not illustrated) in known fashion. So constructed, drive pinion 58*a* is considered to be permanently affixed to cam assembly 52*a*. When it is desired to change the timing, or stroke, of the looper drive shaft, in this instance, so that a different stroke control range may be provided other than that provided by cam profile of stub shaft 54*a*, cam assembly 52*a* as well as drive pinion 58*a* attached thereto are removed from the drive assembly 5**, and replaced with a new cam assembly and drive pinion of the desired cam/stroke profile.

Drive lever **66*a* has a first end 67*a* and a spaced second end 68*a*, as also illustrated in FIG. 4. Defined within the first end of the drive lever 66*a* is an elongate slot 70*a* which extends in the direction of the length of the drive lever from the first end toward the second end thereof. A conventional clamp block/bracket assembly 71*a* is provided at the second end of the drive lever, and is affixed to knife drive shaft 34** by passing a plurality of threaded fasteners (not illustrated) through the first piece (not illustrated) of the clamp block assembly into one of a series of threaded openings (not illustrated) defined in the second piece (not illustrated) of the clamp block assembly formed as a part of the second end of the drive lever, so that the clamp lock assembly securely affixes the drive lever to the knife drive shaft.

A second bearing assembly **64*a* is provided at the second end 60*a* (FIG. 4) of drive pinion 58*a*. Bearing assembly 64*a* is a conventional roller bearing assembly, and fits within the second end of the drive pinion and is secured on the drive pinion when drive assembly 5 is assembled. This is accomplished by the use of a link pin 73, a link pin 73 being provided to operably connect the second end 60*a*, 60*b* of each drive pinion 58*a*, 58*b* to the first end 67*a*, 67*b* of each drive lever 66*a*, 66*b***, respectively.

Link pin 73 has a smooth surfaced end 74 and an opposed threaded end 75, the threaded end being constructed and arranged to be passed through one of elongate slots **70*a*, 70*b* defined in the first end of each drive lever. An intermediate washer 76 is positioned between the smooth surfaced end and the threaded end of the link pin. The smooth surfaced end 74 of the link pin is received within the bearing assembly 64***a*, 64*b* housed in the second end of each respective drive pinion 58*a*, 58*b* so that intermediate washer 76 sandwiches bearing assemblies 64*a*, 64*b*, respectively, therein with a separately provided washer 79 through which a threaded fastener 78 is passed. The threaded fastener 78 is received within a threaded opening 80 defined in the smooth surfaced end of the link pin, as illustrated in FIG. 2, so that the respective bearing assemblies are secured within the second end of the respective drive pinions. After the threaded end 75 of the link pin has been passed through one of slots 70*a*, 70*b*, a separately provided washer 82 is passed thereover, whereupon a nut 83 is threaded onto the end of the link pin and affixes the link pin to the first end of the respective lever in the desired position along slot 70*a*, 70*b* so that the link pin will rotate within bearing assembly 64*a*, 64*b* of drive pinions 58*a*, 58*b*, respectively, to accomplish the pivotal connection of the second end of the drive pinion to the first end of the drive lever.

Cam assembly 52*b*, drive pinion 58*b*, drive lever 66*b* (using a second link pin 73) are fastened to one another in identical fashion, although the configuration of drive lever 66*b* differs from that of 66*a* in that drive lever 66*b* is passed around looper drive shaft 31. Otherwise, that portion of drive assembly 5 which powers looper drive shaft 31 is identical to that portion of drive assembly 5 which powers knife drive shaft 34.

When drive assembly 5 is assembled and placed into position on tufting machine 7, each one of cam assemblies 52*a*, 52*b* will be aligned with timing reference mark 50*a*, 50*b* in a home position which is in the center of the arcuate adjustment range 55*a*, 55*b* of each cam assembly. By analogy, this can best be equated to a top dead center position or bottom dead center position. The offset of stub shafts 54*a*, 54*b* is predetermined to correspond to a predefined cam profile so that drive assembly 5 will move looper drive shaft 31 and knife drive shaft 34 in a predetermined timed relationship with respect to the rotation of tufting machine drive shaft 16. As known to those skilled in the art, modular looper assemblies 32 will be reciprocably driven toward and away from needles 89 (FIG. 5) as they penetrate the backing material (not illustrated) in tufting zone in order to catch the yarn held by the needles, and for drawing the yarn back from the needles as the needles are withdrawn backwards through the tufting zone so that a loop, or tuft, of material is formed. At the same time, modular knife assemblies 35 are being moved in timed relationship with respect to the movement of the modular looper assemblies so that a shearing action is imparted by each one of the knives (not illustrated) of each knife assembly against each one of the loopers (not illustrated) of the looper assemblies to shear the loop to create the tufted cut pile effect desired.

In order to change the stroke of drive pinions 58*a*, 58*b* for varying the timed relationship of modular looper assemblies 32 and modular knife assemblies 35 with respect to the rotation of tufting machine drive shaft 16, which itself controls the reciprocation of needle bar 90 (FIG. 5), cam assemblies 52*a*, 52*b* can be separately adjusted by loosening the retainer screws (not illustrated) holding the respective split face clamp 53*a*, 53*b* on spindle shaft 40, so that the split face clamp may be rotated about stub shaft 40 through the range of timing indicia 55*a*, 55*b* scribed on the respective split face clamps, as the timing indicia are moved with respect to timing reference marks 50*a*, 50*b* so that precise adjustment of the stroke of the looper assemblies, and/or knife assemblies can be obtained.

The unique belt driven drive assembly of this invention also allows for a second degree of stroke adjustment by the loosening of nuts 83*a*, 83*b* so that the threaded end 75*a*, 75*b* of respective link pins 73*a*, 73*b* is loosened thus allowing the link pin, and thus drive pinions 58*a*, 58*b*, respectively, to be moved within the length of slots 70*a*, 70*b* to further adjust, or fine tune, the position of the knives (not illustrated) of modular knife assemblies 35 with respect to the loopers (not illustrated) of the modular looper assemblies 32 to ensure proper timing of the movement of the knives with respect to the loopers. Accordingly, the present invention allows for not one, but for two precision stroke control adjustments to be made within one drive assembly, which thus allows for far greater flexibility in stroke adjustment than heretofore known in the art. By allowing for stroke control through the use of elongate slots 70*a*, 70*b*, more stroke control can be obtained than would be otherwise obtainable through using only a fixed connection, i.e. no slot, so that the only stroke control is obtained by rotating cam assemblies 52*a*, 52*b* about spindle shaft 40.

Referring now to FIG. 5, a pivot shaft 85 is supported on bed plate 86 positioned parallel to and spaced from base plate 11, on which drive assembly 5 is mounted. A rocker arm 87 pivots about pivot shaft 85 and is fastened to an intermediate link 88 for allowing modular looper assemblies 32 to reciprocate with respect to tufting zone 37. Needle 89 is one of a spaced series of needles extending along the length of needle bar 90 which reciprocates toward and away from the tufting zone, the needle bar being attached to a push rod 91 which is itself driven by tufting machine drive shaft 16 (FIG. 1), and thus the need for moving the loopers and the knives with respect to the movement of the needles, and of their respective drive shafts, is illustrated. Push rod 91 may be driven by an apparatus such as that disclosed in the patents to Card et al., U.S. Pat. Nos. 4,586,445, and 4,665,845, respectively. Also, modular looper assemblies 32 may be those self-aligning gauging modules disclosed in U.S. Pat. No. 5,400,727 to Neely, and U.S. Pat. No. 5,513,586 to Neely, et al. Moreover, modular knife assemblies 35 may be those modular knife blocks disclosed in U.S. Pat. No. 4,669,171 to Card, et al.

Figure 6:
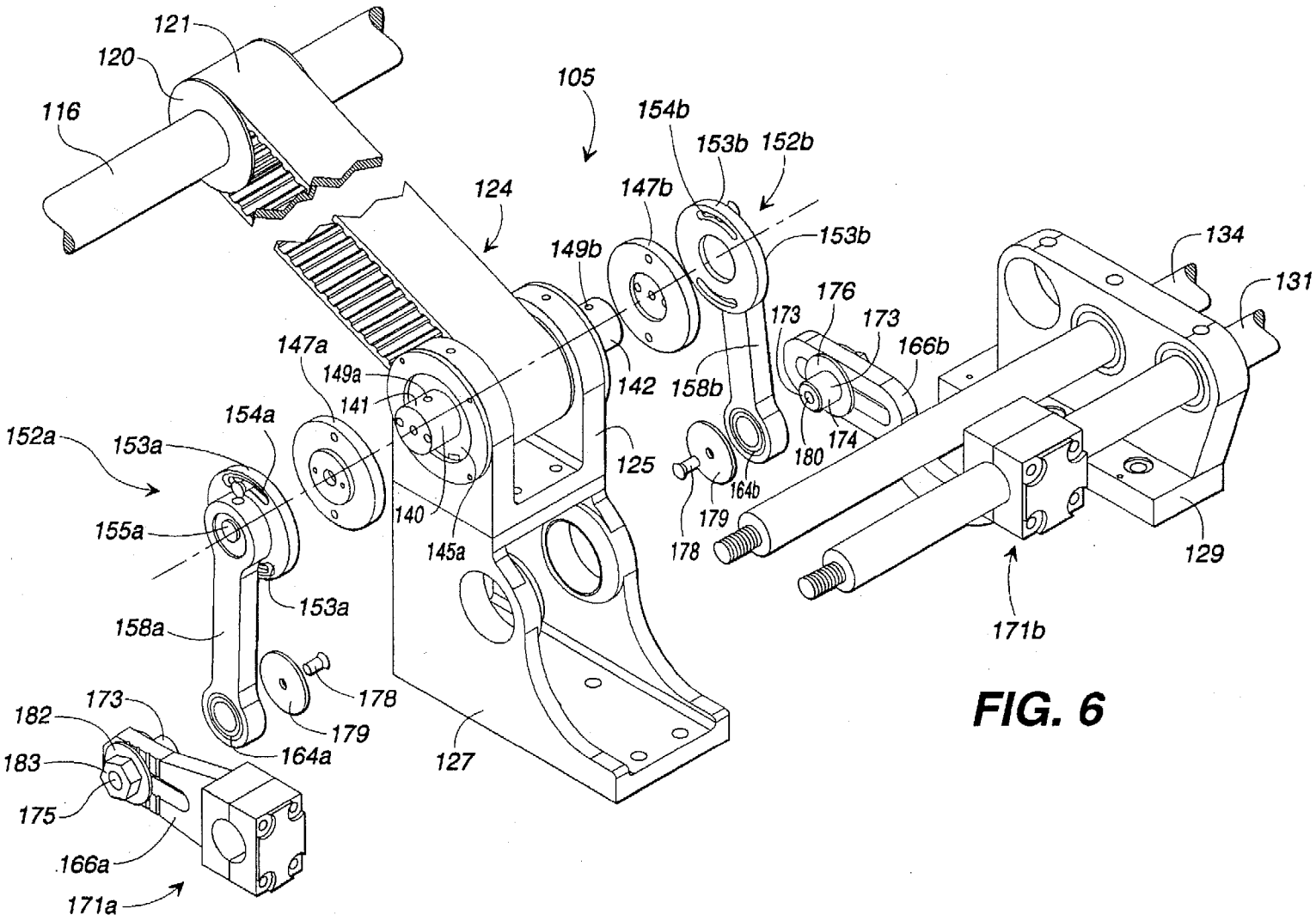
FIG. 6 is an exploded perspective view of an alternate embodiment of the belt driven drive assembly of this invention.

An alternate embodiment of tufting machine belt driven drive assembly 5 is illustrated in FIG. 6 as drive assembly 105. Drive assembly 105 is identical to drive assembly 5, with the exception that timing discs 47*a*, 47*b* are replaced one apiece by one of a pair of drive discs 147*a*, 147*b*, each of which is threadedly fastened to the respective ends 141, 142 of spindle shaft 140, and cam assemblies 52*a*, 52*b* do not comprise split face clamps, rather they comprise a cam disc 153*a*, 153*b*. Each respective cam disk has a spaced and opposed pair of arcuate slots 154*a*, 154*b* defined therein, and is secured by threaded low head fastener passed one apiece through each one of the slots 154*a*, 154*b* into respective drive discs 147*a*, 147*b*. Thus, rather than using timing indicia 55*a*, 55*b* (FIG. 2) moved with respect to a timing reference mark 50*a*, 50*b*, respectively (FIG. 2), the cam discs 153*a*, 153*b* may be loosened and rotated about spindle shaft 140 through the path of travel described by each slot 154*a*, 154*b*. Although no timing indicia are indicated as being scribed on the periphery of these cam discs, it is anticipated that a series of timing indicia could be provided, and that a timing reference mark could also be provided on the respective drive discs so that a precise and exact measurement of the stroke change of the stub shafts 155*a*, 155*b*, could be obtained to again allow for precise stroke adjustment of looper drive shaft 131 and knife drive shaft 134 with respect to tufting machine drive shaft 116. Otherwise, drive assembly 105 is identical to drive assembly 5 in that it includes drive pinions 158*a*, 158*b*, pivotally fastened to a pair of drive levers 166*a*, 166*b*, clamped by respective clamp block assemblies 171*a*, 171*b* to knife drive shaft 134 and to looper drive shaft 131, respectively.

While preferred embodiments of the invention have been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims below are intended to include any structure, material, or acts for performing the functions in combination with other claimed elements as specifically claimed herein.

We claim:

1. In a tufting machine for carrying out a tufting operation in which a series of successive tufts are made in a backing material being advanced through a tufting zone on the tufting machine, the tufting machine having a frame, an elongate rotatable drive shaft supported on an upper portion of the frame, a drive motor for rotating the drive shaft on the frame, an elongate looper drive shaft and an elongate and generally parallel knife drive shaft each rotatably mounted on a lower portion of the frame and being spaced from the drive shaft and with respect to each other, the looper drive shaft having a spaced series of loopers disposed thereon with respect to the tufting zone and the knife drive shaft having a spaced series of knives disposed thereon with respect to the loopers, the improvement comprising:

a spindle assembly mounted on the frame with respect to the looper drive shaft and the knife drive shaft, said spindle assembly having a spindle support and an elongate spindle shaft rotatably supported thereon, said spindle shaft extending along a longitudinal axis and being parallel to both the looper drive shaft and the knife drive shaft, said spindle shaft having a first end and a spaced second end;

drive means for transmitting the rotational movement of the drive shaft to said spindle shaft;

a first cam assembly mounted on the first end of the spindle shaft, said first cam assembly carrying a first stub shaft protruding therefrom and being offset with respect to the axis of said spindle shaft for orbiting said axis during rotation of the spindle shaft;

a first elongate drive pinion pivotally fastened at one of its ends to said first stub shaft for being reciprocated thereby;

a first elongate lever pivotally fastened at one of its ends to said first drive pinion and fixed at the other of its ends on the looper drive shaft for transmitting the reciprocating motion of said first drive pinion as a rocking motion of the looper drive shaft and of the loopers thereon toward and away from the tufting zone;

a second cam assembly mounted on the second end of the spindle shaft, said second cam assembly carrying a second stub shaft protruding therefrom and being offset with respect to the axis of said spindle shaft for orbiting said axis during rotation of the spindle shaft;

a second elongate drive pinion pivotally fastened at one of its ends to said second cam assembly for being reciprocated thereby; and a second elongate lever pivotally fastened at one of its ends to said second drive pinion and fixed at the other of its ends on the knife drive shaft for transmitting the reciprocating motion of said second drive pinion as a rocking motion of the knife drive shaft and of the knives thereon toward and away from the loopers in timed relationship with the movement of the loopers toward and away from the tufting zone.

2. The tufting machine of claim 1, further comprising a drive sprocket mounted on the drive shaft and a driven sprocket mounted on the spindle shaft in substantial alignment with said drive sprocket, said drive means for transmitting the rotational movement of the drive shaft to said spindle shaft comprising a drive belt encircling said drive sprocket and said driven sprocket for rotating said spindle shaft in timed relationship with the rotation of the drive shaft.

3. The tufting machine of claim 1, further comprising a first timing disc affixed to the spindle shaft adjacent said first cam assembly and a second timing disc affixed to the spindle shaft adjacent said second cam assembly.

4. The tufting machine of claim 3, said first cam assembly and said second cam assembly each comprising a split face clamp fastened to the respective ends of said spindle shaft, each said split face clamp having a spaced series of timing indicia defined on at least a portion thereof, said timing indicia being positioned adjacent the timing reference mark defined on the adjacent one of said timing discs, each said split face clamp being constructed and arranged for movement about said spindle shaft as said timing indicia are moved relative to the timing reference mark of the adjacent timing disc so that the rotational position of said first cam assembly and said first stub shaft, and of said second cam assembly and of said second stub shaft, respectively, about said spindle shaft may be varied with respect to the rotational position of the tufting machine drive shaft for adjusting the relative position of the loopers and of the knives, respectively, with respect to the tufting machine drive shaft.

5. The tufting machine of claim 1, wherein the end of each said lever pivotally fastened to each respective drive pinion includes an elongate slot defined therein and extending therethrough, said slot extending in the direction of the length of each said lever, and wherein a link pin is pivotally held at one of its ends on the end of each said drive lever opposite the end thereof pivotally fastened to said first and to said second cam assemblies, respectively, the other end of said link pin being passed transversely through said slot and being affixed to the end of each said lever along the slot for adjusting the relative position of the looper drive shaft and of the knife drive shaft with respect to each other and with respect to the spindle shaft.

6. In a tufting machine for carrying out a tufting operation in which a series of successive tufts are made in a backing material being advanced through the tufting machine, the tufting machine having a frame, an elongate rotatable drive shaft supported on an upper portion of the frame, a drive motor for rotating the drive shaft on the frame, an elongate looper drive shaft spaced from an elongate and generally parallel knife drive shaft, each one of the shafts being rotatably supported on a lower portion of the frame spaced from the drive shaft, the looper drive shaft having a spaced series of loopers disposed thereon with respect to the tufting zone and the knife drive shaft having a spaced series of knives disposed thereon with respect to the loopers, the improvement comprising:

a spindle assembly mounted on the frame with respect to the looper drive shaft and the knife drive shaft, said spindle assembly having a spindle support and an elongate spindle shaft rotatably supported thereon, said spindle shaft extending along a longitudinal axis and having a first end and a spaced second end, each said end protruding from said spindle assembly;

drive means for transmitting the rotational movement of the drive shaft to said spindle shaft;

a first cam assembly mounted on the first end of the spindle shaft;

a first elongate drive pinion operably fastened to said first cam assembly for being reciprocated by said first cam assembly;

a first elongate lever pivotally fastened at one of its ends to said first drive pinion and fixed at the other of its ends on the looper drive shaft for transferring the reciprocating motion of said first drive pinion into a rocking motion of the looper drive shaft and of the loopers thereon toward and away from the tufting zone;

a second cam assembly mounted on the second end of the spindle shaft;

a second elongate drive pinion operably fastened to said second cam assembly for being reciprocated by said second cam assembly; and a second elongate lever pivotally fastened at one of its ends to said second drive pinion and fixed at the other of its ends on the knife drive shaft for transferring the reciprocating motion of said second drive pinion into a rocking motion of the knife drive shaft and of the knives thereon toward and away from the loopers in timed relationship with the movement of the loopers toward and away from the tufting zone.

7. The tufting machine of claim 6, further comprising a drive sprocket mounted on the drive shaft and a driven sprocket mounted on the spindle shaft in substantial alignment with said drive sprocket, said drive means for transmitting the rotational movement of the drive shaft to said spindle shaft comprising a flexible timing belt encircling said drive sprocket and said driven sprocket for rotating said spindle shaft in timed relationship with the rotation of the drive shaft.

8. The tufting machine of claim 6, further comprising a first timing disc affixed to said spindle shaft adjacent said first cam assembly, and a second timing disc affixed to said spindle shaft adjacent said second cam assembly, each said timing disc extending transversely with respect to said spindle shaft and having a timing reference mark defined on the periphery thereof.

9. The tufting machine of claim 8, said first cam assembly and said second cam assembly each comprising a split face clamp fastened to the respective ends of said spindle shaft and a spaced series of timing indicia defined on at least a portion of each said split face clamp, said timing indicia being positioned adjacent the timing reference mark defined on the adjacent one of said timing discs, each said split face clamp being constructed and arranged for movement about said spindle shaft as said timing indicia are moved relative to said timing reference mark so that the rotational position of said first cam assembly and of said second cam assembly, respectively, on said spindle shaft may be varied with respect to the rotational position of the tufting machine drive shaft for adjusting the relative position of the loopers and of the knives, respectively, with respect to the tufting machine drive shaft and with respect to each other.

10. The tufting machine of claim 6, said first cam assembly having a first transverse stub shaft protruding therefrom, said first stub shaft being offset with respect to the axis of said spindle shaft for movement in an orbital path about the axis of said spindle shaft, said first drive pinion being pivotally fastened at one of its ends to said first stub shaft for being reciprocated thereby as the stub shaft orbits the spindle shaft.

11. The tufting machine of claim 10, further comprising:

a first timing disc affixed to said spindle shaft adjacent said first cam assembly, said first timing disc having a timing reference mark defined on the periphery thereof;

said first cam assembly comprising a first split face clamp fastened to the first end of said spindle shaft and a spaced series of timing indicia defined on at least a portion thereof, said timing indicia being positioned adjacent the reference timing mark on said first timing disc;

wherein said first split face clamp is constructed and arranged for movement about said spindle shaft as said timing indicia are moved relative to the timing reference mark on the first timing disc whereby the rotational position of said first cam assembly and said first stub shaft about said spindle shaft is varied with respect to the rotational position of the tufting machine drive shaft for adjusting the relative position of the loopers within the tufting zone in relation to the position of the tufting machine drive shaft.

12. The tufting machine of claim 6, said second cam assembly having a second transverse stub shaft protruding therefrom, said second stub shaft being offset with respect to the axis of said spindle shaft for movement in an orbital path about the axis of said spindle shaft, said second drive pinion being pivotally fastened at one of its ends to said second stub shaft for being reciprocated thereby as the stub shaft orbits the spindle shaft.

13. The tufting machine of claim 12, further comprising:

a second timing disc affixed to said spindle shaft adjacent said second cam assembly, said second timing disc having a timing reference mark defined thereon;

said second cam assembly comprising a second split face clamp fastened to the second end of said spindle shaft and a spaced series of timing indicia defined on at least a portion thereof, said timing indicia being positioned adjacent the reference timing mark on said second timing disc;

wherein said second split face clamp is constructed and arranged for movement about said spindle shaft as said timing indicia are moved relative to the timing reference mark on the second timing disc whereby the rotational position of said second cam assembly and said second stub shaft about said spindle shaft is varied with respect to the rotational position of the tufting machine drive shaft for adjusting the relative position of the knives within the tufting zone in relation to the position of the tufting machine drive shaft.

14. The tufting machine of claim 6, wherein the axis of said spindle shaft is parallel to the looper drive shaft and to the knife drive shaft.

15. In a tufting machine for carrying out a tufting operation in which a series of successive tufts are made in a backing material being advanced through a tufting zone on the tufting machine, the tufting machine having a frame, a first elongate drive shaft rotatably supported on an upper portion of the frame, a drive motor for rotating the first drive shaft on the frame, a second elongate drive shaft spaced from the first drive shaft and being rotatably supported on a lower portion of the frame, the improvement comprising:

a) a spindle assembly mounted on the frame with respect to the second drive shaft, said spindle assembly having a spindle support and an elongate spindle shaft rotatably supported thereon, said spindle shaft extending along a longitudinal axis parallel to said second drive shaft and having at least a first end protruding therefrom;

b) drive means for transmitting the rotational movement of the drive shaft to said spindle shaft;

c) a cam assembly mounted on the at least one end of the spindle shaft, said cam assembly including:

a first transverse stub shaft protruding therefrom and being offset with respect to the axis of the spindle shaft for movement in an orbital path about the axis of the spindle shaft.

a timing disc affixed to said spindle shaft, said timing disc having a timing reference mark defined on the periphery thereof;

a split face clamp fastened to the at least one end of said spindle shaft adjacent said timing disc, said split face clamp having a spaced series of timing indicia defined thereon, said timing indicia being in at least partial registry with the reference timing mark on said timing disc, wherein said split face clamp is constructed and arranged for movement about said spindle shaft as said timing indicia are moved relative to the timing reference mark on the timing disc so that the rotational position of said cam assembly and said stub shaft about said spindle shaft is varied with respect to the rotational position of the first drive shaft;

d) an elongate drive pinion having a first end and a spaced second end, the first end of said drive pinion being pivotally fastened to said stub shaft for transmitting the orbital motion of said stub shaft as a reciprocating motion; and e) an elongate lever having a first end and a spaced second end, the first end of said lever being pivotally fastened to the second end of said drive pinion and being fixed at its second end on the second drive shaft for transferring the reciprocating motion of said drive pinion into a rocking motion of the second drive shaft.

16. The tufting machine of claim 15, wherein the first end of said lever includes an elongate slot defined therein and extending therethrough, said slot extending in the direction of the length of said lever, and wherein a link pin is pivotally held at one of its ends on the second end of said drive lever, the other end of said link pin being passed transversely through said slot and affixed to the first end of said lever along said slot for adjusting the relative position of the second drive shaft with respect to the spindle shaft.

17. A tufting machine for carrying out a tufting operation in which a series of successive tufts are sewn into a backing material being advanced through a tufting zone defined by the tufting machine, said tufting machine comprising:

a frame;

an elongate rotatable drive shaft supported on an upper portion of the frame;

a drive motor for rotating said drive shaft;

an elongate looper drive shaft and an elongate and generally parallel knife drive shaft, said looper shaft and said knife shaft each being rotatably mounted on a lower portion of the frame, said looper drive shaft and said knife drive shaft being spaced from the drive shaft and from each other, said looper drive shaft having a spaced series of loopers disposed thereon with respect to the tufting zone and said knife drive shaft having a spaced series of knives disposed thereon with respect to the loopers;

a spindle assembly mounted on the frame with respect to the looper drive shaft and the knife drive shaft, said spindle assembly having an elongate spindle shaft rotatably supported thereon, said spindle shaft extending along a longitudinal axis and having a first end and a spaced second end;

a drive sprocket mounted on the drive shaft;

a driven sprocket mounted on the spindle shaft, said driven sprocket being spaced from said drive sprocket and in substantial alignment therewith;

a flexible timing belt encircling said drive sprocket and said driven sprocket for rotating said spindle shaft in timed relationship to the rotation of said drive shaft;

a first timing disc affixed to the first end of said spindle shaft;

a second timing disc affixed to the second end of said spindle shaft;

a first cam assembly mounted on said spindle adjacent said first timing disc;

a second cam assembly mounted on said spindle adjacent said second timing disc;

a first elongate drive pinion operably fastened at one of its ends to said first cam assembly for being reciprocated by said first cam assembly;

a second elongate drive pinion operably fastened to said second cam assembly for being reciprocated by said second cam assembly;

a first elongate lever operably fastened at one of its ends to said first drive pinion and fixed at the other of its ends on the looper drive shaft for transferring the reciprocating motion of said first drive pinion into a rocking motion of said looper drive shaft and of the loopers thereon toward and away from the tufting zone in timed relationship with the rotation of the tufting machine drive shaft; and a second elongate lever operably fastened at one of its ends to said second drive pinion and fixed at the other of its ends to the knife drive shaft for transferring the reciprocating motion of said second drive pinion into a rocking motion of said knife drive shaft and of the knives thereon toward and away from said loopers in timed relationship with the movement of said loopers toward and away from the tufting zone.

18. The tufting machine of claim 17, said first cam assembly carrying a first stub shaft protruding therefrom and being offset with respect to the axis of said spindle shaft for orbiting said axis during rotation of the spindle shaft, and said second cam assembly carrying a second stub shaft protruding therefrom and being offset with respect to the axis of the spindle shaft for orbiting said axis during rotation of the spindle shaft.

19. The tufting machine of claim 18, said first stub shaft and said second stub shaft each being offset with respect to the other about the axis of said spindle shaft.

20. The tufting machine of claim 18, said first cam assembly and said second cam assembly each comprising a split face clamp fastened to the respective ends of said spindle shaft and a spaced series of timing indicia defined on at least a portion of said split face clamp, said timing indicia being positioned adjacent the timing reference mark defined on the adjacent one of said timing discs, each said split face clamp being constructed and arranged for movement about said spindle shaft as said timing indicia are moved relative to said timing reference mark so that the rotational position of said first and of said second cam assemblies, respectively, on said spindle shaft may be varied with respect to the rotational position of the tufting machine drive shaft for adjusting the relative position of the loopers and of the knives, respectively, with respect to the tufting machine drive shaft.

21. A method of tufting a series of successive tufts in a backing material being advanced through a tufting zone defined in a tufting machine, the tufting machine having a frame with an elongate rotatable drive shaft supported on an upper portion of the frame, a drive motor for rotating the drive shaft, an elongate looper drive shaft and an elongate and generally parallel knife drive shaft each rotatably mounted on a lower portion of the frame, said looper drive shaft and said knife drive shaft each being spaced from the drive shaft and from each other, the looper drive shaft having a spaced series of loopers disposed thereon with respect to the tufting zone and the knife drive shaft having a spaced series of knives disposed thereon with respect to the loopers, said method including the steps of:

rotating an elongate spindle shaft supported on a spindle assembly mounted on the frame in timed relationship with the rotation of the drive shaft, said spindle shaft extending along a longitudinal axis and having a first end and a spaced second end;

mounting a first cam assembly on the first end of the spindle shaft, carrying a first stub shaft protruding from said first cam assembly and being offset with respect to the axis of said spindle shaft on said first cam assembly, and orbiting said first stub shaft about the axis of the spindle shaft;

reciprocating a first elongate drive pinion pivotally fastened to said first stub shaft in response thereto;

rocking the looper drive shaft and the loopers carried thereon toward and away from the tufting zone with a first elongate lever pivotally fastened at one of its ends to said first drive pinion and fixed at the other of its ends on the looper drive shaft;

mounting a second cam assembly on the second end of the spindle shaft, carrying a second stub shaft protruding therefrom and being offset with respect to the axis of said spindle shaft on said second cam assembly, and orbiting said second stub shaft about the axis of the spindle shaft;

reciprocating a second elongate drive pinion pivotally fastened to said second stub shaft in response thereto; and rocking the knife drive shaft, and the knives carried thereon, toward and away from the loopers in timed relationship with the movement of the loopers toward and away from the tufting zone with a second elongate lever pivotally fastened at one of its ends to said second drive pinion and fixed at the other of its ends on the knife drive shaft.

22. The tufting method of claim 21, further comprising the step of varying the offset of said first stub shaft about the axis of said spindle and varying the timed relationship of the looper drive shaft with respect to the movement of the tufting machine drive shaft in response thereto.

23. The tufting method of claim 21, further comprising the step of varying the offset of said second stub shaft about the axis of said spindle and varying the timed relationship of the knife drive shaft with respect to the movement of the tufting machine drive shaft in response thereto.

24. The tufting method of claim 21, wherein said step of rotating said spindle shaft in timed relationship with the rotation of the drive shaft comprises the steps of:

positioning a drive sprocket on the drive shaft;

positioning a driven sprocket on said spindle shaft in substantial alignment with said drive sprocket; and encircling said drive sprocket and said driven sprocket with a timing belt for transferring the rotational movement of the drive shaft to said spindle shaft.

25. The method of claim 21, further comprising the step of rotating said first cam assembly on said spindle shaft to change the position of the first stub shaft about said spindle shaft, and varying the timed relationship of the looper drive shaft with respect to the spindle shaft in response thereto.

26. The method of claim 21, further comprising the step of rotating said second cam assembly on said spindle shaft to change the position of the second stub shaft about said spindle shaft, and varying the timed relationship of the knife drive shaft with respect to the spindle shaft in response thereto.

27. The method of claim 21, further comprising the step of rotating said first cam assembly on said spindle shaft to change the position of the first stub shaft about said spindle shaft, rotating said second cam assembly on said spindle shaft to change the position of the second stub shaft about said spindle shaft, and varying the timed relationship of the looper drive shaft with respect to the knife drive shaft as well as varying the timed relationship between both the looper drive shaft and the knife drive shaft with respect to the spindle shaft in response thereto.

* * * * *